United States Patent [19]

Sanchez-Caldera et al.

[11] Patent Number: 4,706,730

[45] Date of Patent: Nov. 17, 1987

[54] MIXING AND CASTING APPARATUS

[75] Inventors: Luis E. Sanchez-Caldera, Hudson; Nam P. Suh, Sudbury; Jung-Hoon Chun, Hopedale; Arthur K. Lee, Clinton, all of Mass.; Frederick S. Blackall, IV, Cumberland, R.I.

[73] Assignee: Mixalloy Corporation, Hudson, Mass.

[21] Appl. No.: 6,886

[22] Filed: Jan. 27, 1987

[51] Int. Cl.[4] ..... B22D 18/00; B22D 35/00

[52] U.S. Cl. ..... 164/135; 164/113; 164/312; 264/11; 264/299

[58] Field of Search ..... 164/135, 133, 113, 306, 164/312, 284; 264/11, 299

[56] References Cited

U.S. PATENT DOCUMENTS 4,278,622 7/1981 Suh ..... 264/11
4,279,843 7/1981 Suh ..... 264/11

OTHER PUBLICATIONS

N. P. Suh—"Orthonormal Processing of Metals, Part 1: Concept and Theory", Jun. 1983, Paper No. 82--Prod-18.

N. P. Suh et al.—"Orthonormal Processing of Metals, Part 2: Mixalloying Process", Jun. 1983, Paper 82--Prod-19.

Arnold Erickson et al.—"Injection Molding", Metals Handbook, 9th Ed., 1984, vol. 7.

Charles Wick—"Chapter 16—Casting", Tool and Manufacturing Engineers Handbook, 4th ed., 1984, vol. 2.

*Primary Examiner*—Kuang Y. Lin

*Attorney, Agent, or Firm*—Robert F. O'Connell

[57] ABSTRACT

A technique for forming a composite mixture of materials, at least one of which is a metal, in which each of the materials is supplied in a molten or slurry state to separate channels. The materials are then supplied to one or more mixing regions substantially simultaneously where they are caused to impinge upon each other to form a composite mixture thereof. The composite mixture is supplied to one or more cooling regions for casting, the supplying of the materials to the separate channels, the forming of the composite mixture and the casting being performed in a substantially continuous operation.

12 Claims, 11 Drawing Figures

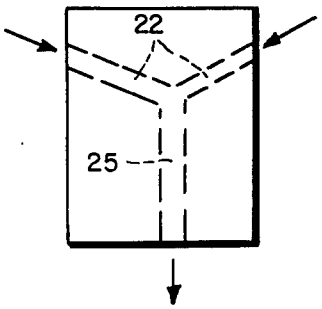
FIG. 4
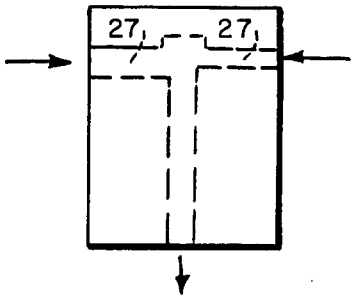
FIG. 5
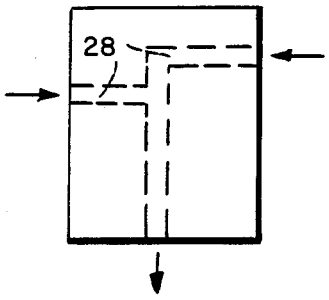
FIG. 4A
FIG. 4B
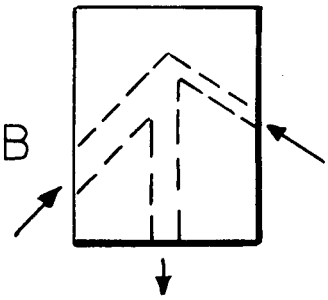
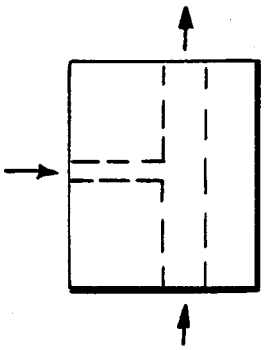
FIG. 4C
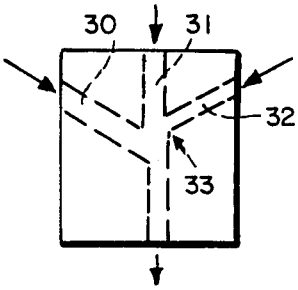
FIG. 6
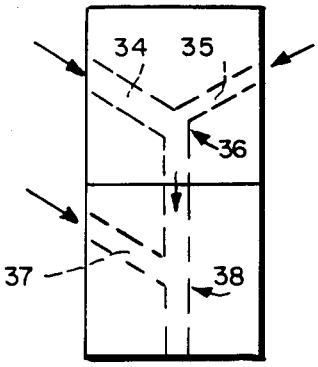
FIG. 7
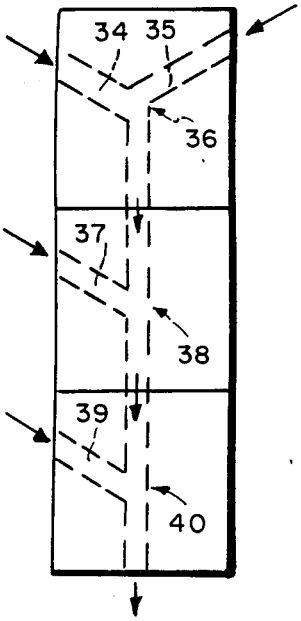
FIG. 8

MIXING AND CASTING APPARATUS

INTRODUCTION

This invention relates generally to mixing and casting apparatus and processors and, more particularly, to a unique mixing technique for providing distribution particles of a mixed material which can then be used in a casting apparatus for producing one or more castings of the mixed materials in substantially a single operation.

BACKGROUND OF THE INVENTION

Die casting has been used to form metal castings for many years and produces precise and finished parts which require little or no additional machining.

In die casting, a highly efficient process, a single piston and sleeve arrangement is used for supplying a metal, or metal alloy, to the casting apparatus. The piston is withdrawn to a position which uncovers an opening, or pouring hole, into which molten metal can be poured so as to partially fill a shot chamber formed by the sleeve and piston. The piston is then moved forward so as to force the molten metal into a die cavity. After the metal, or metal alloy, has solidified, the part is ejected from the die. If metal alloys are to be utilized in the die casting process, the materials thereof are alloyed in a separate process and the alloy is then carried to the die casting machine for insertion through the pouring holes of the shot chamber. It is thus mandatory that the metal, or metals, used be readily miscible in the liquid state.

Die casting, however, has not been used to produce metallic composite parts, i.e., parts which comprise a metal, or metal alloy, matrix to which an additional phase is added. The additional phase can be a polymer, a ceramic, glass, or another metal which is immiscible with the matrix metal or metal alloy. These parts are usually manufactured by using powder metallurgy (P/M) techniques in which the component powders are mixed in a blender, following which the blended mixture is pressed in a mold and sintered. Recently injection molding technology, whose application thus far has been limited only to polymeric materials, has been adopted as an alternative means for fabricating metallic, ceramic and cermet parts. In such technique, fine component powders (e.g., in the order of 10 microns) are mixed with thermoplastic binders in a blender until the mixture reaches a slurry-like consistency. The slurry is subsequently injected into a mold at a low hydrostatic pressure using a piston and shot sleeve arrangement. The molded parts are removed from the mold and placed in a furnace, the binder removed, and the parts sintered to higher densities.

While the above mentioned P/M and injection molding techniques are capable of fabricating metallic composite parts, they involve an initial, and separate, mixing or blending operation. In the cases of both conventional P/M or injection molding processes, solid component powders are used as the starting materials, the products being selected so that the composite can meet the requirement of a subsequent sintering step.

It would be desirable to devise an appropriate technique and apparatus for permitting both the mixing of materials in a molten, or a slurry, state to form metallic composite materials (i.e., a combination of metals, or metal alloys, with glass, polymers and/or ceramics) and the casting of articles from said mixed materials in a single apparatus in a substantially continuous operation.

In that way the apparatus can both fabricate the desired metallic composite material and cast the finished parts in one overall and cost effective operation, particularly when compared to P/M and injection molding techniques.

BRIEF SUMMARY OF THE INVENTION

A mixing and casting system or apparatus according to the invention includes an injection section of an apparatus which supplies molten (or slurry) materials to be mixed, at least one of which is of metal, through separate channels each having a means for moving a material through the channel to a mixing region. The materials are supplied to a mixing region of the injection section substantially simultaneously under pressure in a manner such that the materials indirectly impinge upon each other so as to cause the materials to form a mixture thereof. The term indirect impingement, as used herein, is described and explained in more detail below.

A casting section of the apparatus is in direct communication with the mixing region and the mixture of materials is supplied from the mixing region to the casting section as the mixture is being formed so as to produce one or more castings of the mixed materials in a substantially continuous operation.

In a further embodiment of the invention the mixing process can be used to mix two or more materials, at least one of which is a metal, which materials are capable of producing, when mixed, a chemical reaction so that, when the materials are supplied to the mixing region in their molten or slurry states, such materials impinge indirectly upon each other at velocity and temperature conditions which are selected to cause the materials simultaneously to mix and to chemically react with each other so as to produce a stable reaction product thereof.

DESCRIPTION OF THE INVENTION

The invention can be described in more detail with the help of the accompanying drawings wherein:

FIGS. 4, 4A, 4B and 4C show diagramatically mixing techniques for mixing materials in accordance with the invention;

FIG. 5 shows diagramatically a technique for mixing materials in accordance with the prior art; and FIGS. 6, 7 and 8 show alternative techniques for mixing more than two materials in accordance with the invention.

Figure 1:
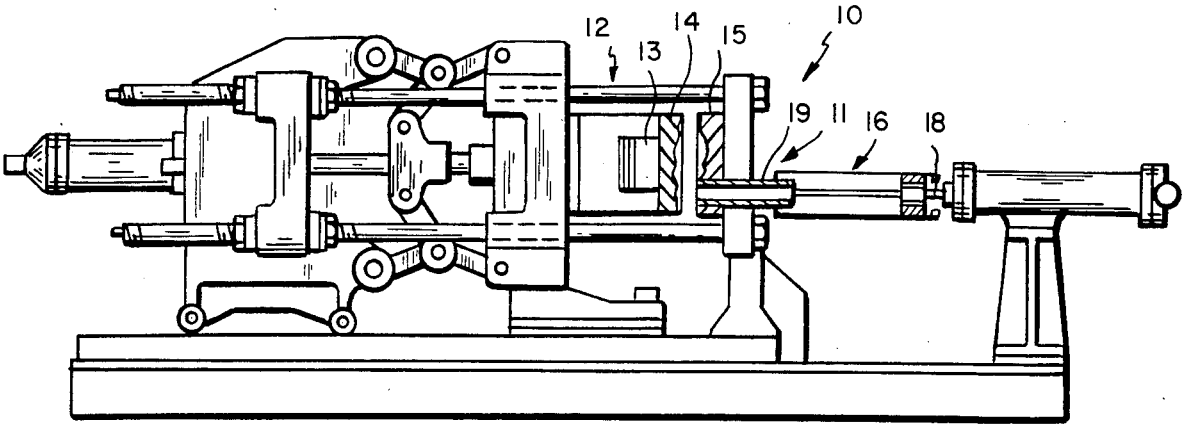
FIG. 1 shows diagrammatically a side-view of an apparatus which represents an exemplary embodiment of the invention.

FIG. 1 shows a side-view of a typical die casting apparatus such as is discussed in the text "Die Casting", by H. H. Doehler, published in 1951 by McGraw Hill Company, Inc.

As can be seen in FIG. 1, an overall apparatus 10 comprises an injection section 11 and a casting section 12. Casting section 12 may be in the form of a conventional die caster including a sliding plate 13 having an ejector die 14 at one end thereof. When the plate and ejector die are placed at their farthest movable right position in the figure a die cavity is formed between the ejector die 14 and a fixedly mounted cover die 15, as shown.

The injection section 11 of apparatus 10 includes a plurality of piston and shot sleeve units 16 (shown more clearly in FIG. 2) into each of which one component of a desired multi-component mixture is supplied in its molten form through pouring holes 17 when the piston, or plunger rod, 18 has been withdrawn to a suitable position to permit the pouring hole to be in communication with the shot sleeve 19.

Figure 2:
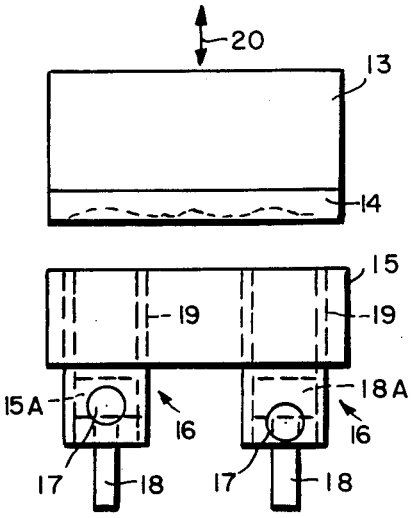
FIG. 2 shows diagramatically a plan view of a portion of the apparatus of FIG. 1.
Figure 3:
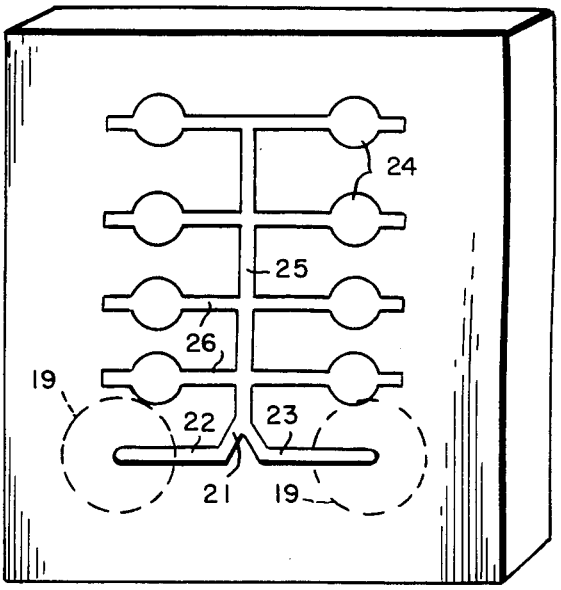
FIG. 3 shows a perspective view of the ejector die portion of the apparatus of FIG. 1.

As seen in FIG. 2 the mixing apparatus in an exemplary embodiment of the invention uses a pair of metal shot sleeve units 19 each utilizing a movable plunger rod 18 having plunger, or piston tips 18A. Each sleeve includes at least one pouring hole 17 and the sleeve extends through cover die 15. Ejector die 14 and sliding plate 13 are shown diagramatically in FIG. 2 as movable in the two directions shown by arrow 20. A particularly emodiment of the ejector die is shown more specifically in FIG. 3, wherein the shot sleeves 19 are in communication with a mixing region 21 via transport lines 22 and 23, respectively. The mixing region 21 is in turn in communication with a plurality of die cavities 24, each of which is used to form a finished article, via a suitable main channel 25 and auxillary channels 26, as shown.

The configuration of the transport lines 22 and 23 together with the mixing region 21 and main transport line 25 provides an effective "Y" configuration which is shown diagramatically in FIG. 4. Such a configuration can be contracted with that in FIG. 5 in which molten materials are supplied via transport lines 27 which are in line with each other (i.e. at a 180° relationship) so that the materials directly impinge upon each other, in a head-on manner.

The impingement technique utilized in FIG. 4 provides a configuration in which the materials impinge on each other in an oblique manner which is defined herein as "indirect" impingement wherein the transport lines for the molten materials have an angular relationship to each other which is other than 180°.

In a further alternative arrangement set forth in FIG. 4A the molten materials are supplied through transport lines 28 so as to impinge upon each other at an angle substantially equal to 90°. Other examples of such indirect impingement techniques are shown in FIGS. 4B and 4C.

The above mixing techniques are based on a process described in U.S. Pat. Nos. 4,278,622 and 4,279,843 issued on July 14, 1981 and July 21, 1981, respectively, to N. P. Suh, which patents discuss a technique for mixing, or fabricating, alloys of metals by using orthonormal processing techniques which allow the uncoupling of certain processing variables and properties. The process described therein involves an impingement and mixing of streams of molten liquids wherein the liquids are supplied to a mixing region in a manner such that they directly impinge upon each other, i.e., at a 180° angular relationship to each other in a "head-on" manner, as shown in FIG. 5. The fluid mechanics and heat transfer considerations affect the microstructure of the resulting material. It has been found, however, that in utilizing the technique described therein, in which direct impingement is used, instabilities in the exit, or mixed, stream of materials occur. For example, if one stream of material arrives at the mixing chamber before the other, it is possible that the side at which the later arriving stream is supplied may become clogged. Such instabilities produce a mixed material having undesirable characteristics. In contrast, it has been found in accordance with the invention that such instabilities can be avoided if the indirect impingement techniques described above are utilized.

The use of multiple piston/sleeve arrangements for supplying molten materials, at least one of which is a molten metal material, to a mixing region in combination with a die casting machine provides a very successful system for producing castings of mixed materials, such as metal alloys, wherein the mixing and casting process can occur in a single apparatus in a substantially continuous overall operation.

The above apparatus can not only be used to provide mixtures of materials, at least one of which is, or includes, a metal, e.g. metal alloys, but also can be used to induce a chemical reaction between selected constituents of a mixture when at least one of the materials is metallic so long as the materials are capable of producing a chemical reaction. Accordingly, if the molten materials are selected so as to produce, when mixed, a chemical reaction between them, the indirect impingement of such materials under selected velocities and temperature conditions can cause the mixtures simultaneously to mix and to chemically react so as to produce a stable reaction product thereof. For example, if materials X and Y, each of which is present in a matrix material M, are mixed in accordance with the invention at velocities lying in a suitable range and at temperatures lying within a suitable range, the apparatus produces a composition which is the stable reaction product of X and Y in the matrix M. The particle sizes and the particular characteristics of the microstructure of the reacted product can be controlled by controlling the temperature and the composition of the molten streams, by controlling the velocities at which they impinge (the velocities in turn control the size of the turbulent eddies which are produced during the impingement process and the rate at which the mixture enters the cooling region), and by controlling the solidification, or cooling, rate.

Normally, for example, the desired velocities can best be determined empirically and will depend on the materials used. The velocities of the materials to be mixed will depend on the desired microstructure of the final mixture. The temperature used is selected so as to provide molten materials which achieve good flow characteristics and often is found to be at a value slightly higher than the melting point of the materials involved. Hence, the selection of specific velocities and temperatures for specific materials will be within the skill of the art.

In the formation of particles from a mixture of materials in accordance with the invention, it has been found that such particles tend to improve the mechanical properties (e.g., strength, ductility, etc.) of the resulting mixture. While only two molten streams are shown as producing a mixed material in the exemplary embodiment described, it is clear that the above approach can be extended to include more than two streams of molten materials to form more complex alloys or mixtures. The design of the mixing section must take into account the differences in momentum flux between the impinging streams, which characteristically is related to the density of the materials used and the square of the velocities thereof. A desired design can be achieved, for example, by controlling the pistons so that they move at different speeds in different sleeves or by having different nozzle sizes for the entry of the molten materials into the mixing region. Such variations in speed and nozzle size produce appropriate variations in velocity which permit the molten materials to enter the chamber with substantially the same momentum flux so as to provide the most effective mixture thereof.

The making of cast parts in accordance with the invention so as to produce finished products of composite materials, such as metals, metal alloys, polymers, ceramics, or glass, can be done in a much more cost effective manner using the above mixing technique than is possible when using conventional powder metallurgy techniques.

As an example of the use of the method described above, the system can use the frame of any appropriate die casting machine and replace the conventional single piston/sleeve configuration with a multiple sleeve and mixing region arrangement which is coupled to the ejector die structure of the die casting machine, as described above, in which the ejector die includes both a part of the casting mold and mixing region where the molten materials indirectly impinge and mix due to the turbulent eddies formed when supplying the molten materials thereto. Such a combination permits the fabrication of articles from the mixed materials in a single continuous operation. The ejector die coupled with the cover die each having corresponding grooves on their front faces form the mixing region and the mixer and casting transport lines, as required.

When used with a cold chamber die casting machine frame as shown in FIG. 1, for example, the system could be operated as follows to produce a batch of finished articles. During the molten material loading stage, the plunger rods retract leaving the pouring holes open. At this time the cover and ejector die are closed. Different molten materials are then poured into each of the shot sleeves and, after the shot sleeves have been at least partially filled with such materials, the rods are pushed forward at predetermined velocities. The forward motion forces the molten materials into the mixing region where they impinge upon each other to form a molten mixture which is supplied to one or more die cavities—where the mixed material is solidified. The ejector die is then retracted and the batch of finished parts is retrieved so that the apparatus is again ready to make the next batch.

The types of materials utilized as well as the design of die grooves and cavities are in the control of and can be specified by the user. In addition different material volume ratios can be selected by using shot sleeves of different diameters and/or by varying the piston velocities depending on the desired application. While the particular embodiments described above disclose techniques for mixing two materials, it is clear that more than two materials can be mixed in mixing regions as shown in FIG. 6 wherein three piston/sleeve configurations 30, 31 and 32 are supplied with three different materials to a single mixing region 33 where they indirectly impinge upon each other. Alternatively as shown in FIG. 7, two of the materials can be supplied from piston/sleeve configurations 34 and 35 to a first mixing region 36, the output of which is in turn mixed with a third material supplied from a third piston/sleeve configuration 37 in a second mixing region 38. Such concept can be extended to mix still further materials as described in the example FIG. 8 wherein four materials are mixed using three successive mixing regions 36, 38 and 40 as shown.

The particular embodiments described above are not to be considered as the only embodiment of the invention and variations thereof will occur to those in the art within the spirit and scope of the invention. Hence, the invention is not to be construed as limited to the specific embodiments discussed above, except as defined by the appended claims.

What is claimed is:

1. An apparatus comprising means for providing two or more materials in a molten or a slurry state, at least one of which includes a metal;

means for supplying each of said materials to separate channels each having means for moving said materials through said channels;

one or more mixing regions for receiving said two or more materials from said channels;

means associated with each channel for supplying the materials therein from said channels substantially simultaneously to said one or more mixing regions, the materials thereby indirectly impinging on each other in each of said one or more mixing regions so as to form a composite mixture thereof; and means for supplying said composite mixture to one or more cooling die regions for casting said composite mixture into articles, the supplying of said materials, the forming of a composite mixture thereof, and the casting of said composite mixture into articles being performed in a substantially continuous operation.

2. An apparatus in accordance with claim 1 wherein each of two materials at least one of which includes a metal is supplied to a separate one of two channels and said two materials are supplied substantially simultaneously to a single mixing region, the two materials thereby indirectly impinging on each other in said mixing region to form a composite mixture thereof.

3. An apparatus in accordance with claim 1 wherein both of said materials are metals.

4. An apparatus in accordance with claim 1 wherein each of three or more materials is supplied to separate ones of three or more channels and said three or more materials are supplied substantially simultaneously from said channels to a single mixing region to indirectly impinge on each other to form a composite mixture thereof.

5. An apparatus in accordance with claim 1 wherein each of two materials is supplied to a single mixing region to form a first mixture thereof and a third material is supplied together with said first mixture to a second mixing region to form a second composite mixture of said third material and said first mixture.

6. An apparatus in accordance with claim 5 and further including a third mixing region, a fourth material being supplied together with said second mixture to said third mixing region to form a third mixture of said fourth material and said second mixture.

7. An apparatus in accordance with claim 1 wherein each of said channels comprises a sleeve member, an opening in said sleeve member for permitting the insertion of a material therein in a molten or slurry state, and movable piston means for moving the material inserted therein under pressure into a mixing region.

8. An apparatus comprising means for providing at least two materials in a molten or slurry state, at least one of said materials includes a metal, which materials are capable of producing, when mixing, a chemical reaction;

means for supplying each of said materials to separate channels each having means for moving said materials through said channels;

at least one mixing region for receiving said at least two materials from said channels;

means associated with each channel for supplying the materials therein from said channels to said at least one mixing region substantially simultaneously at selected velocities and at temperatures which are selected to cause said materials to chemically react with each other in said at least one mixing region, the molten materials thereby indirectly impinging on each other so as to chemically react with each other to produce a mixture of the stable reaction products thereof; and means for supplying said mixture to at least one cooling die region for casting said mixture into articles, the supplying of said materials, the forming of a mixture thereof, and the casting of said mixture into articles being performed in a substantially continuous operation.

9. An apparatus in accordance with claim 8 wherein each of said channels comprises a sleeve member, an opening in said sleeve member of permitting the insertion of a material therein, and movable piston means for moving the material inserted therein under pressure into a mixing region.

10. A method of forming a composite mixture of at least two materials at least one of which includes a metal, said method comprising the steps of (1) providing said materials in their molten or slurry states;

(2) causing said materials to indirectly impinge upon each other substantially simultaneously in at least one mixing region to form a composite mixture thereof; and (3) supplying said composite mixture to at least one cooling die region to cast said composite mixture into one or more articles;

steps (1), (2) and (3) being performed in a substantially continuous operation.

11. A method of forming a mixture of at least two materials which are capable of producing, when mixed, a chemical reaction, said method comprising the steps of (1) providing said materials in their molten or slurry states;

(2) causing said molten materials to indirectly impinge upon each other substantially simultaneously in at least one mixing region at selected velocities and temperatures to cause said materials to chemically react with each other to form a mixture of the stable reaction products thereof; and (3) supplying said mixture to at least one cooling region to form a solid mixture thereof;

steps (1), (2) and (3) being performed in a substantially continuous operation.

12. A method in accordance with claim 11 wherein said cooling region is a cooling die region to cast said mixture into one or more articles.

* * * * *